US006974027B2

(12) United States Patent
Boriani et al.

(10) Patent No.: US 6,974,027 B2
(45) Date of Patent: Dec. 13, 2005

(54) RIGID CIGARETTE PACKET

(75) Inventors: Silvano Boriani, Bologna (IT); Alberto Franchini, Monteveglio (IT); Fiorenzo Draghetti, Medicina (IT)

(73) Assignee: G.D Societa' Per Azioni, Bologna (IT)

( * ) Notice: Subject to any disclaimer, the term of this patent is extended or adjusted under 35 U.S.C. 154(b) by 19 days.

(21) Appl. No.: 10/432,418

(22) PCT Filed: Nov. 22, 2001

(86) PCT No.: PCT/IT01/00587

§ 371 (c)(1),
(2), (4) Date: Nov. 7, 2003

(87) PCT Pub. No.: WO02/42181

PCT Pub. Date: May 30, 2002

(65) Prior Publication Data

US 2004/0060833 A1 Apr. 1, 2004

(30) Foreign Application Priority Data

Nov. 23, 2000 (IL) ..... BO2000A0684

(51) Int. Cl.[7] ..... A24F 15/00
(52) U.S. Cl. ..... 206/268; 206/273
(58) Field of Search ..... 206/245, 259, 206/261, 262, 268, 266, 271, 273, 265

(56) References Cited

U.S. PATENT DOCUMENTS

| | | | | | |
|---|---|---|---|---|---|
| 785,279 | A | * | 3/1905 | Steiner | 220/215 |
| 798,729 | A | * | 9/1905 | Jefferd | 206/121 |
| 1,326,070 | A | * | 12/1919 | Lewis | 206/265 |
| 1,598,316 | A | * | 8/1926 | Scharling | 206/121 |
| 1,851,828 | A | * | 3/1932 | Gold et al. | 292/174 |
| 1,853,760 | A | * | 4/1932 | Davis | 206/259 |
| 2,652,060 | A | * | 9/1953 | Cheng | 131/351 |
| 3,245,525 | A | * | 4/1966 | Shoemaker | 206/249 |
| 4,752,029 | A | | 6/1988 | Buford | |
| 5,379,889 | A | * | 1/1995 | Cobler | 206/268 |
| 6,138,823 | A | * | 10/2000 | Focke et al. | 206/259 |

FOREIGN PATENT DOCUMENTS

| | | |
|---|---|---|
| DE | 295 03 238 | 4/1995 |
| DE | 199 06 473 | 8/2000 |
| GB | 328751 | 5/1930 |
| WO | WO 01/72606 | 10/2001 |

* cited by examiner

*Primary Examiner*—Shian T. Luong
(74) *Attorney, Agent, or Firm*—Marshall, Gerstein & Borun LLP

(57) ABSTRACT

A rigid cigarette packet (1), in the form of a right parallelepiped and extending along an axis (Z), has a container (4), and a lid (5) hinged to the container (4) along a hinge (6) so as to move between a closed position and an open position in which the lid (5) permits access to a compartment (14), housing cigarettes (2), through an opening (15) in the container (4), which has a front wall (9), a rear wall (10), two lateral walls (11), a bottom wall (12), and a top wall (13); the opening (15) extends along the front wall (9), between the hinge (6) on the front wall (9) and a free edge (18) of the front wall (9).

20 Claims, 5 Drawing Sheets

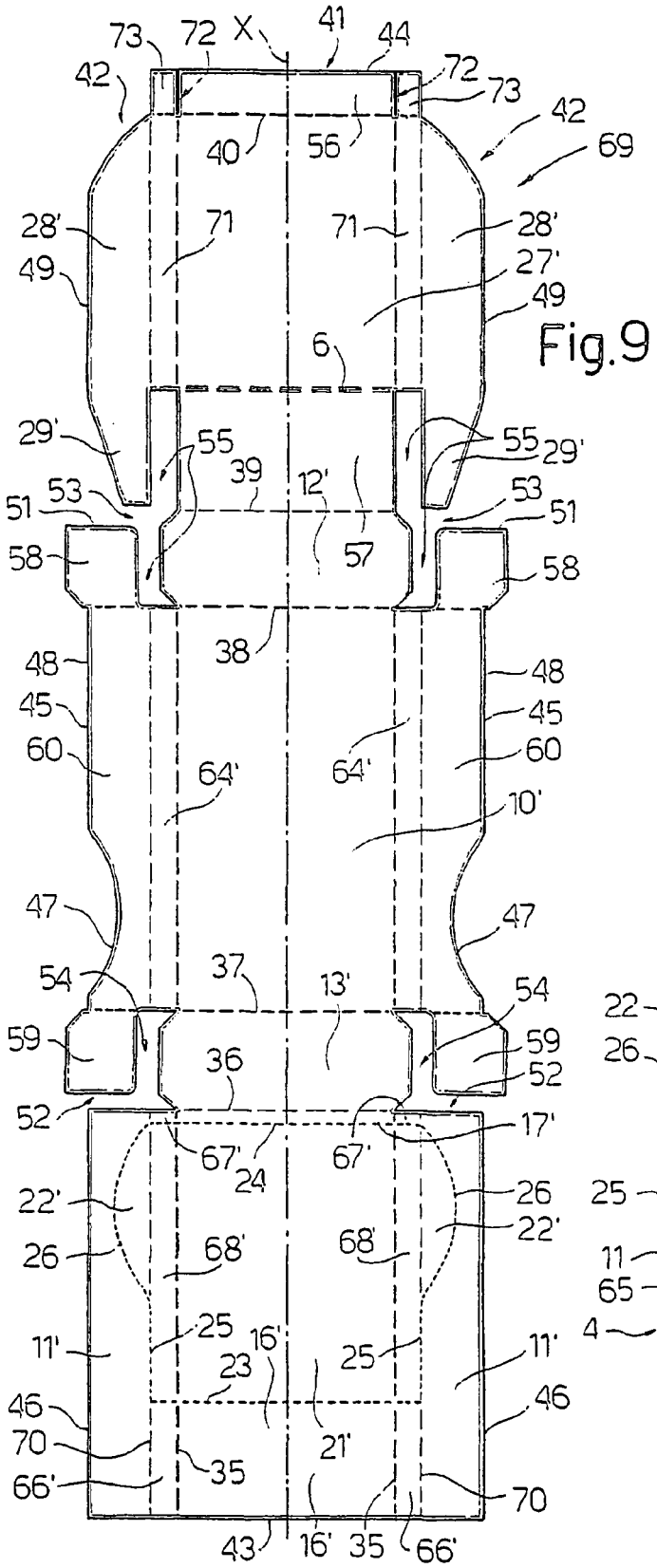
Fig.9
Fig.8
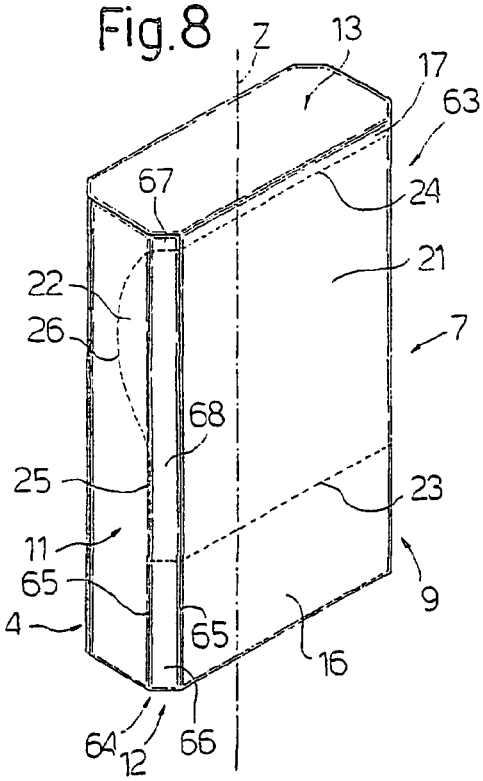

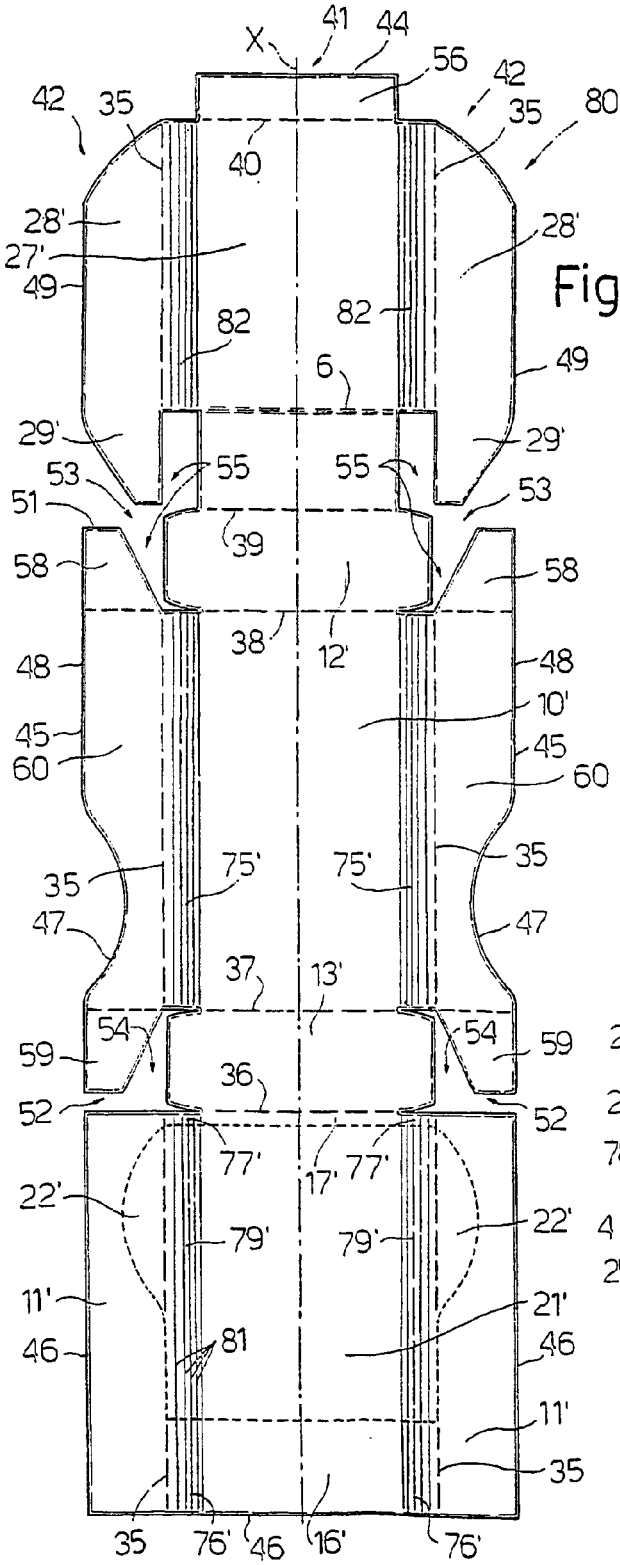
Fig.11
Fig.10
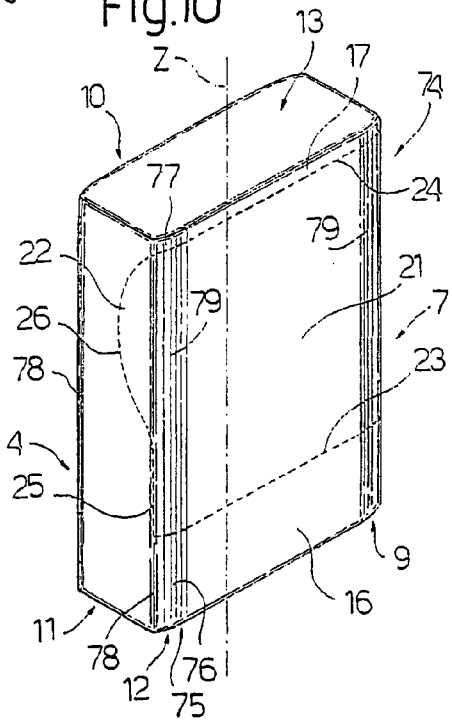

RIGID CIGARETTE PACKET

CROSS REFERENCE TO RELATED APPLICATION

This is the U.S. national phase application of International Application No. PCT/IT01/00587, filed 22 Nov. 2001.

TECHNICAL FIELD

The present invention relates to a rigid cigarette packet.

BACKGROUND ART

A conventional rigid cigarette packet is normally in the form of a right parallelepiped extending along a longitudinal axis and comprising a cup-shaped container having a front wall, a rear wall, two lateral walls and a bottom wall; and a cup-shaped lid which, like the container, has a front wall, a rear wall, two lateral walls and a top wall, and is hinged to the container by a hinge between the rear wall of the container and the rear wall of the lid.

The above type of packet is commonly known as a rigid hinged-lid packet, and is formed from a rigid cardboard blank comprising preformed fold lines, along which it is folded to form the packet. The packet of cigarettes is subsequently wrapped in a sheet of overwrapping material for sealing the packet and maintaining the right degree of humidity of the cigarettes.

The above rigid packet has been marketed successfully for many years, during which, several variations have been designed to make it more practical and improve folding of the blank when forming the packet. A rigid hinged-lid packet and its many variations, however, all share a common drawback closely related to the structure of the packet. More specifically, when the lid is turned about the hinge, a rigid hinged-lid packet has an opening which substantially corresponds to a section of the packet crosswise to the longitudinal axis, and through which the cigarettes project from the container to be gripped by the user.

The cigarettes are normally oriented with the filters facing the lid, so that the filter must be gripped by the user to withdraw a cigarette from the container. Gripping the cigarette, however, by the filter, which is then placed in the mouth, poses problems of hygiene, which could be solved by inverting the cigarettes, i.e. with the filters facing the bottom wall of the container, so that the plain ends of the cigarettes project from the top end of the container. Though more hygienic, inverting the cigarettes inside a rigid hinged-lid packet means the cigarettes must be gripped by the plain ends, thus resulting in tobacco fallout from the ends of the cigarettes. Moreover, the cup shape of the container and the lid makes it difficult to seal between the lid and the container to prevent deterioration of the cigarettes in the event of accidental tearing of the overwrapping.

DISCLOSURE OF INVENTION

It is an object of the present invention to provide a rigid cigarette packet designed to eliminate the drawbacks of the known state of the art in a straightforward, practical manner.

According to the present invention, there is provided a rigid cigarette packet substantially in the form of a right parallelepiped, extending along an axis, and comprising a container and a lid hinged to said container along a hinge; the container comprising four walls parallel to the axis and forming a loop, a bottom wall crosswise to the axis, an inner compartment for housing cigarettes, and an opening for access to the compartment; at least one of the walls parallel to the axis comprising a free edge; the opening extending between the hinge and said free edge; the cigarettes being arranged, inside said compartment, parallel to said axis; and the packet being characterized in that said container comprises a top wall crosswise to said axis; said hinge extending on the wall parallel to the axis and comprising said free edge.

According to the present invention, the opening of the container, as opposed to corresponding to an end section of the packet, is located along a wall parallel to the axis and may therefore be located at a central portion of the container and not necessarily at one end of the container, as in the case of a hinged cup-shaped lid. Moreover, as opposed to the five-walled container of conventional packets with a hinged cup-shaped lid, the packet according to the present invention has the advantage of having a six-walled container, which makes the packet much stronger than conventional hinged-lid packets, particularly when the lid is left open.

According to a preferred embodiment of the present invention, the packet comprises a removable lid over said hinged lid, which acts as a support for graphics and/or advertising.

Such an embodiment enables application to the hinged lid of advertising, competitions or similar, which are currently forbidden by law on the outer surface of the packet, and which must be inserted inside the packet in the form of coupons, thus complicating manufacture of the packet.

According to a further preferred embodiment of the present invention, the removable lid is connected to the front wall and the lateral walls of the container along continuous tear lines forming an endless path.

The above further preferred embodiment of the invention provides for obtaining a hermetically sealed packet with no need to wrap the packet in a sheet of overwrapping material.

It is a further object of the present invention to provide a blank from which to form the packet according to the present invention in a straightforward, low-cost manner.

According to the present invention, there is provided a flat blank of cardboard from which to form a rigid cigarette packet comprising a container, a hinged lid, and a removable lid over the hinged lid; the blank comprising first panels for forming said container, second panels for forming said hinged lid, and third panels for forming said removable lid; said third panels being separated from said first panels by continuous tear lines forming an endless path.

BRIEF DESCRIPTION OF THE DRAWINGS

A number of non-limiting embodiments of the present invention will be described by way of example with reference to the accompanying drawings, in which:

FIG. 8 shows a view in perspective of a first variation of the FIG. 1 packet;

FIG. 9 shows a plan view of a flat blank from which to form the first variation in FIG. 8;

FIG. 10 shows a view in perspective of a second variation of the FIG. 1 packet;

FIG. 11 shows a plan view of a flat blank from which to form the second variation in FIG. 10.

BEST MODE FOR CARRYING OUT THE INVENTION

Figure 1:
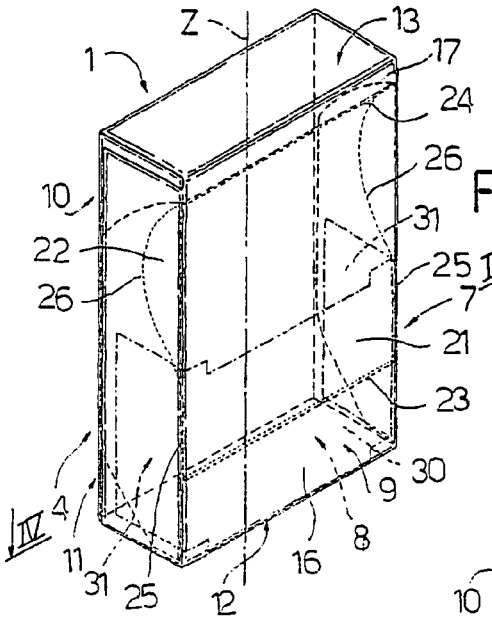
FIG. 1 shows a view in perspective of a rigid cigarette packet in accordance with the present invention.

With reference to FIGS. 1 to 5, number 1 indicates a rigid cigarette packet in the form of a right parallelepiped and extending along a longitudinal axis Z.

Packet 1 houses an orderly group of cigarettes 2 enclosed in a wrapping 3, and comprises a container 4, a lid 5 hinged to container 4 along a hinge 6, a lid 7 removable from container 4, and a collar 8 inside container 4. Container 4, hinged lid 5, removable lid 7 and collar 8 are made of rigid cardboard, while wrapping 3 is made of sheet material, normally foil.

Figure 2:
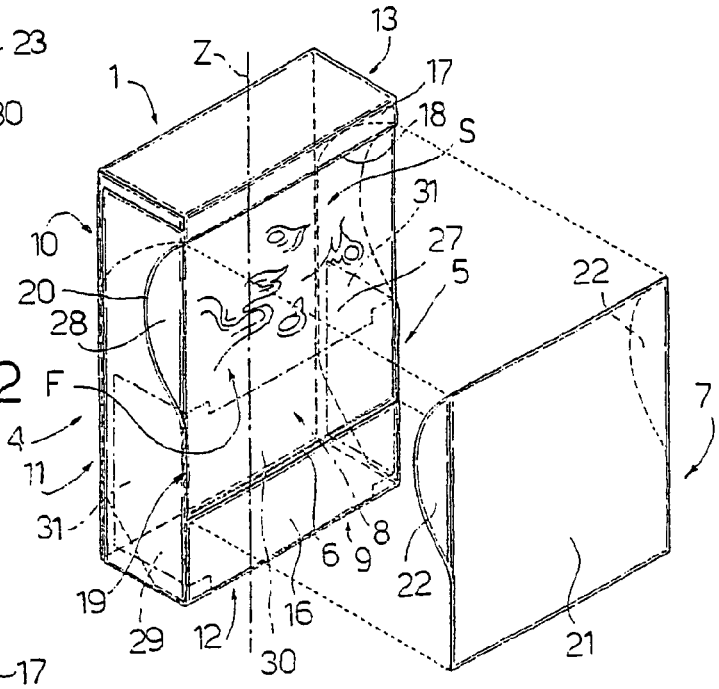
FIG. 2 shows a partly exploded view in perspective of the FIG. 1 packet.
Figure 3:
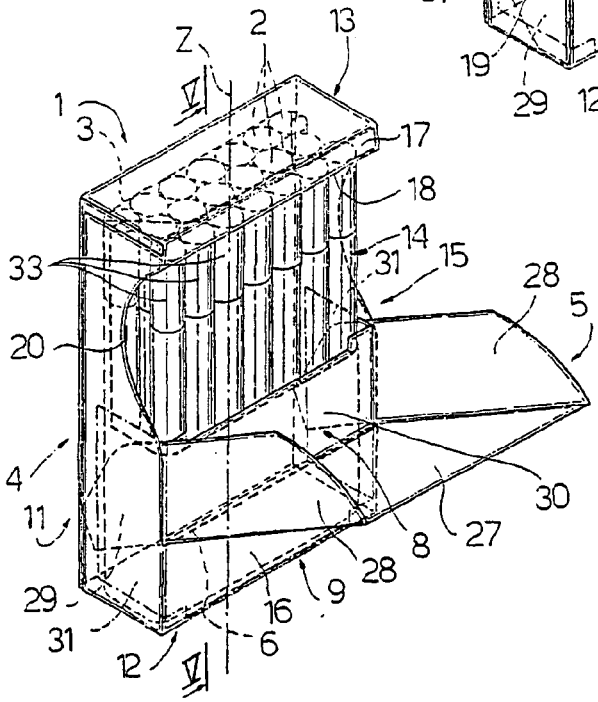
FIG. 3 shows a view in perspective of the FIG. 1 packet in the open position and with part of the packet removed.
Figure 4:
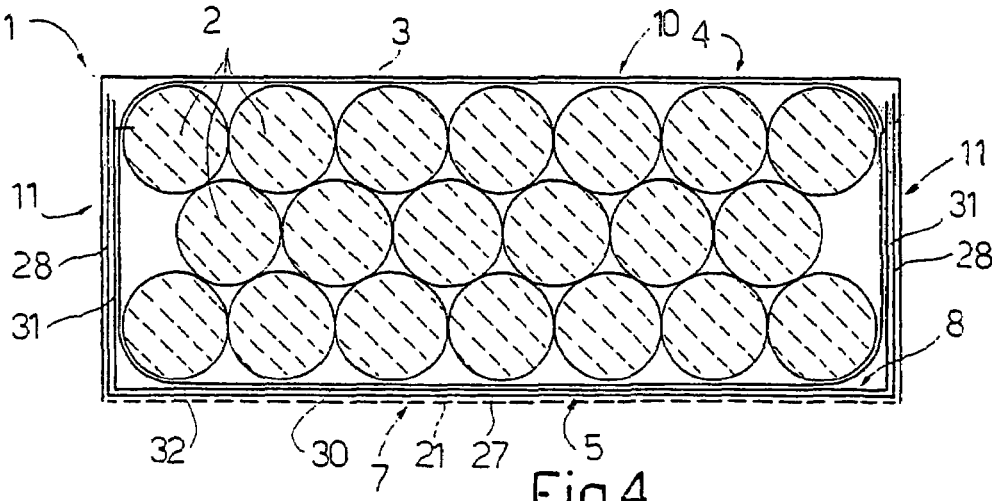
FIG. 4 shows a cross section of the FIG. 1 packet along line IV—IV.

With reference to FIGS. 1 to 3, container 4 comprises a front wall 9 parallel to axis Z; a rear wall 10 parallel to and facing front wall 9; two lateral walls 11 facing and parallel to axis Z and perpendicular to walls 9 and 10; a bottom wall 12 perpendicular to axis Z; and a top wall 13 facing and parallel to bottom wall 12.

As shown more clearly in FIG. 3, container 4 is in the form of a right parallelepiped, and comprises a compartment 14 for housing cigarettes 2; and an opening 15 formed along front wall 9 and lateral walls 11, and permitting access to compartment 14. In other words, the container comprises four walls 9, 10, 11 parallel to the axis and forming a loop; and opening 15 extends along at least one of the walls parallel to axis Z.

With reference to FIGS. 1, 2 and 3, front wall 9 comprises a bottom portion 16 extending between bottom wall 12 and hinge 6; and a top portion 17 extending between top wall 13 and a bottom edge 18 parallel to hinge 6. Each lateral wall 11 defines a straight edge 19 adjacent to hinge 6 and parallel to axis Z; and a curved edge 20 between edge 18 and edge 19. Hinge 6 and edge 18 define opening 15 in a direction parallel to axis Z; and edges 19 and 20 define opening 15 in directions perpendicular to axis Z.

With reference to FIGS. 1 and 2, removable lid 7 comprises a central wall 21, and two lateral walls 22 perpendicular to central wall 21. Before being detached from container 4, removable lid 7 is integral with container 4, is integral with front wall 9 and lateral walls 11, and is located over lid 5. More specifically, central wall 21 is connected to portions 16 and 17 along respective tear lines 23 and 24, and to lateral walls 11 along respective straight tear lines 25, while lateral walls 22 are connected to respective lateral walls 11 by respective curved tear lines 26. Tear lines 23, 24, 25 and 26 define an endless path along the outer surface of packet 1, and are formed by cutting the cardboard so that, when pull is exerted between container 4 and lid 7, lid 7 is detached from container. 4 along said endless path.

Hinged lid 5, when closed, closes the whole of opening 15, and comprises a central wall 27, which, in the closed position shown in FIG. 2, extends, parallel to axis Z, from hinge 6 to edge 18; and two lateral walls 28, which, in the closed position shown in FIG. 2, extend, beneath lateral walls 11, from bottom wall 12 up to edge 18, and are perpendicular to central wall 27. Each lateral wall 28 has an appendix 29, which is not adjacent to central wall 27 and projects towards bottom wall 12; and central wall 27 has an outer face F bearing advertising and/or graphics S which are exposed when removable lid 7 is removed.

Collar 8 is located inside compartment 14, between wrapping 3 and container 4, and comprises a central wall 30, and two lateral walls 31 perpendicular to central wall 30, which projects partly from portion 16 at hinge 6 and extends just short of bottom wall 12. Each lateral wall 31 extends parallel to a respective lateral wall 11 of container 4, from bottom wall 12 up to curved edge 20; and each appendix 29 of hinged lid 5 is located between a respective lateral wall 11 of container 4 and a lateral wall 31 of collar 8, which provide for guiding the appendix when opening and closing hinged lid 5.

Wrapping 3 comprises a removable so-called pull-off portion 32 connected to the rest of wrapping 3 by a prepunched line, and which, when removed, exposes cigarettes 2 at opening 15. Removable portion 32 extends from collar 8 up to part of wrapping 3 facing top wall 13, and extends laterally just short of rear wall 10.

Figure 5:
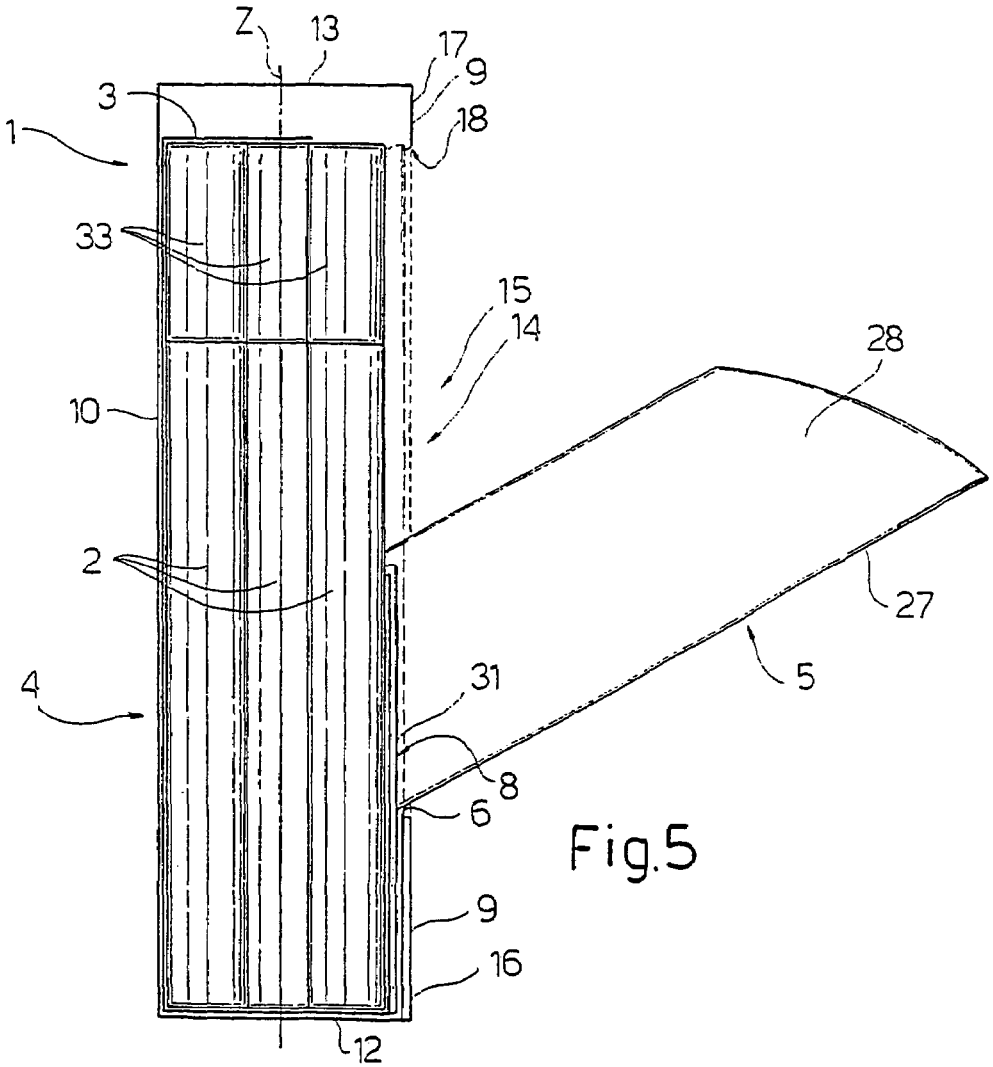
FIG. 5 shows a cross section of the FIG. 3 packet along line V—V.

With reference to FIG. 5, cigarettes 2 are arranged parallel to axis Z inside compartment 14, and comprise respective filters 33 located at and a given distance from top wall 13 of packet 1. In other words, bottom wall 12 and top wall 13 are separated by a distance, along axis Z, greater than the length of cigarettes 2.

In a variation not shown, cigarettes 2 are arranged with filters 33 at bottom wall 12.

In a further variation not shown, cigarettes 2 are arranged parallel to hinge 6, and, combined with the packet 1 described, would be shorter than cigarettes 2 arranged parallel to axis Z. However, packet 1 may be altered in size to house cigarettes arranged parallel to hinge 6 and of the same length as cigarettes 2.

Figure 6:
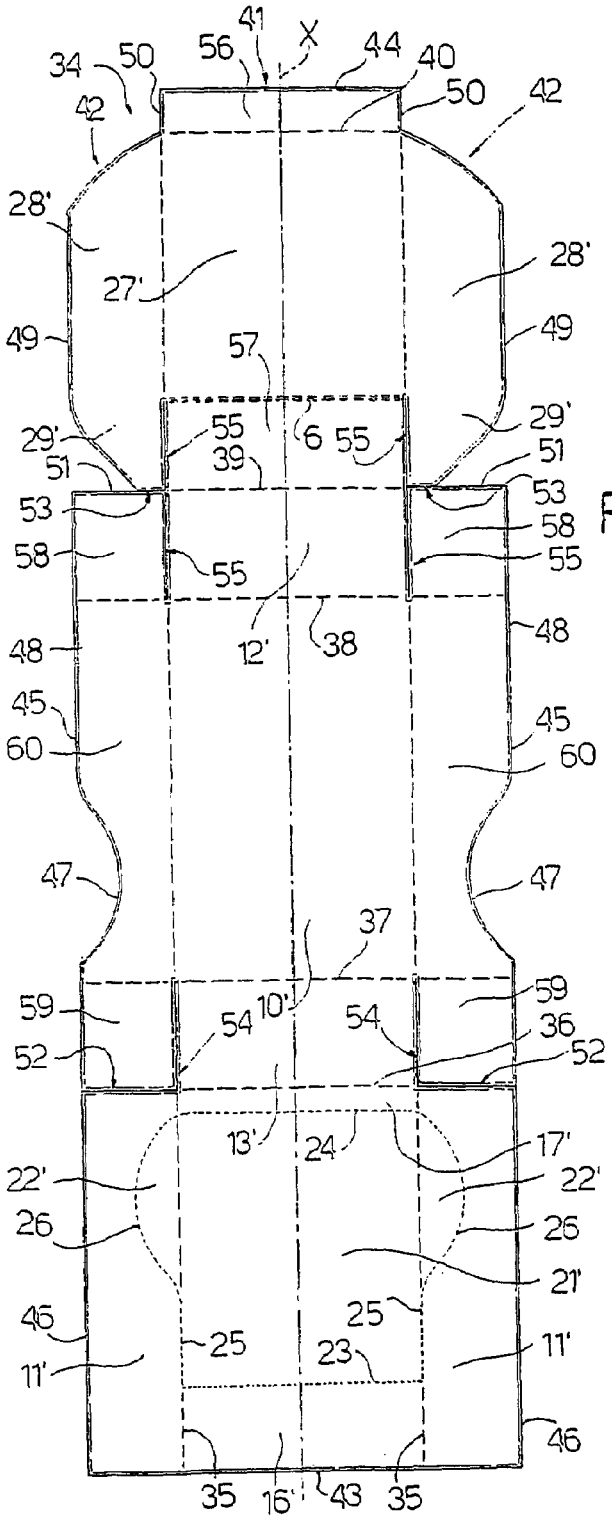
FIG. 6 shows a plan view of a flat blank from which to form the FIG. 1 packet.

Number 34 in FIG. 6 indicates a flat cardboard blank extending along a longitudinal axis X of symmetry and comprising a number of panels described in detail later on. For the sake of simplicity, and to relate blank 34 clearly to packet 1, each panel corresponding to a wall of packet 1 is indicated using the same reference number as for the wall, plus a (').

Blank 34 is substantially in the form of a rectangle elongated in a direction defined by axis X, and comprises two fold lines 35 parallel to and equidistant from axis X, and five lines 36, 37, 38, 39, 40 perpendicular to axis X. Fold lines 35 define on blank 34 a central strip 41 of panels, and two lateral strips 42 of panels specularly symmetrical with respect to axis X. Blank 34 is defined by an outer edge comprising a straight side 43 extending perpendicular to axis X and across the full width of blank 34; a straight side 44 opposite and parallel to side 43 and extending the full width of central strip 41; and two opposite sides 45. Each side 45 comprises a portion 46 parallel to axis X and extending from side 43 to fold line 37; a concave portion 47 and a straight portion 48 which extend between fold lines 37 and 39; a segmented, generally convex portion 49 extending between lines 39 and 40; and a straight portion 50 extending between edge 44 and fold line 40 and forming a theoretical continuation of fold line 35. Blank 34 also comprises an edge 51 at each strip 42 and forming a theoretical continuation of fold line 39.

Each lateral strip 42 is interrupted by a slit 52 coincident with fold line 36, and by a slit 53 coincident with fold line 39, and is separated partly from central strip 41 by a slit 54 extending along fold line 35 from fold line 36 to fold line 37, and by a slit 55 extending along fold line 35 from fold line 38 to fold line 39.

In addition to the panels indicated (′), blank 34 also comprises panels which are not visible from the outside of packet 1, even after removal of removable lid 7. Along central strip 41, such panels comprise a flap 56 defined by side 44, by fold line 40, and by portions 50; and a panel 57 defined by hinge 6, by fold line 39, and by slits 55. Each lateral strip 42 comprises a tab 58 defined by fold line 38, by edge 51, by portion 48, and by slits 53 and 55; a tab 59 defined by portion 46, by fold line 37, and by slits 52 and 54; and a panel 60 defined by fold lines 37 and 38, by portions 47 and 48, and by fold line 35.

Blank 34 is precut to form tear lines 23, 24, 25, 26 and so define, between side 43 and fold line 36, a rectangular panel 21′, and two tabs 22′ separated from panel 21′ by fold lines 35.

Figure 7:
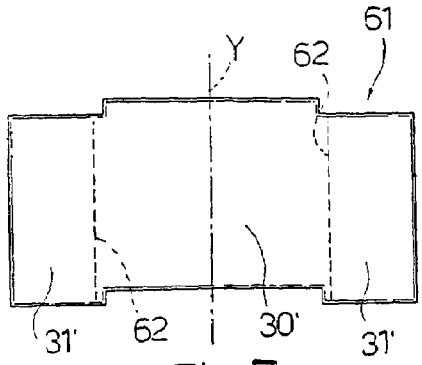
FIG. 7 shows a flat blank from which to form a collar for the FIG. 1 packet.

Number 61 in FIG. 7 indicates a flat cardboard blank from which to form collar 8, and which comprises an axis Y of symmetry, and two fold lines 62 parallel to axis Y and defining a central panel 30′ corresponding to wall 30 of collar 8, and two panels 31′ located on opposite sides of central panel 30′ and corresponding to lateral walls 31 of collar 8.

Packet 1 is formed from blanks 34 and 61 and from a group of cigarettes 2 in a wrapping 3 as follows:

Flap 56 is folded 180° about fold line 40 and glued to panel 27′; the group of cigarettes 2 is placed on panel 10′ at fold line 38; panel 30′ is placed on wrapping 3; and panels 31′ are folded squarely on to wrapping 3 to form collar 8. At this point, tabs 58 and 59 are folded roughly 90° about respective fold lines 38 and 37, and each panel 60 is folded a given angle about respective fold line 35. Panels 28′ are folded squarely about respective fold lines 35; panel 12′ is folded squarely about fold line 38; and panels 57 and 27′ are folded squarely about fold line 39 so that panels 28′ are positioned contacting wrapping 3 and over tabs 31 of collar 8. Panel 13′ is folded squarely about fold line 37; and panels 16′, 17′, 21′, 11′ and 22′ are folded squarely with respect to line 36 and over panels 27′ and 57. At this point, each panel 11′ is folded squarely about respective fold line 35 and glued in known manner to panel 60; and tabs 58 and 59 are glued in known manner to respective panels 12′ and 13′.

Packet 1 is thus closed hermetically, so that no overwrapping is required.

In actual use, the user detaches removable lid 7 to expose the underlying hinged lid 5, which is movable about hinge 6 to permit access to inner compartment 14 of container 4 and to cigarettes 2 inside. To prevent jamming, lateral walls 28 of the hinged lid are guided by lateral walls 11 of packet 1, and by lateral walls 31 of the collar.

Number 63 in FIG. 8 indicates a packet of cigarettes in accordance with a first variation of packet 1. Packet 63 is a beveled-edge packet, and, like packet 1, comprises a container 4, a removable lid 7, a hinged lid 5 (not shown in FIG. 8), and a collar 8 (not shown in FIG. 8). Though the component parts of packet 63 described above differ in shape and/or size from the respective component parts of packet 1, similar component parts are indicated using the same reference numbers as for packet 1 for the sake of simplicity. Front wall 9 and rear wall 10 are connected to lateral walls 11 by bevels 64 forming edges 65 between walls 9, 10 and 11. Each bevel 64 connecting front wall 9 to a respective lateral wall comprises a bottom portion 66 adjacent to bottom portion 16 of front wall 9; and a top portion 67 adjacent to top portion 17 of front wall 9. Removable lid 7 comprises two bevels 68, which are coplanar with the two bevels 64 connecting front wall 9 to lateral walls 11, and connect central wall 21 of lid 7 to lateral walls 22 of lid 7. Besides separating wall 21 from respective portions 16 and 17, tear lines 23 and 24 extend across bevels 64 to separate bevels 68 from respective bottom and top portions 66 and 67 of bevels 64; and tear lines 25 extend along edges 65 between lateral walls 11 and bevels 64. Hinged lid 5 and collar 8 (neither shown in FIG. 8) have bevels between respective central walls 27 and 30 and respective lateral walls 28 and 31.

Number 69 in FIG. 9 indicates a flat cardboard blank extending along a longitudinal axis X of symmetry and comprising a number of panels from which to form packet 63. For the sake of simplicity, and to relate blank 69 clearly to packet 63, each panel corresponding to a wall of packet 63 is indicated using the same reference number as for the wall, plus a (′), and the same reference numbers are used to indicate any parts similar to those of blank 34.

Blank 69 is substantially in the form of a rectangle elongated in a direction defined by axis X of symmetry, and comprises fold lines 70, each of which is parallel to axis X and located between a fold line 35 and a side 45, so as to form, between line 35 and line 70, panels 64′, 68′ and 71, which, once blank 69 is folded, define bevels 64 of container 4, bevels 68 of removable lid 7, and the bevels (not shown in FIG. 8) of hinged lid 5. Blank 69 differs from blank 34 by comprising two slits 72 located at flap 56 and extending along a theoretical continuation of lines 35 to separate flap 56 from two panels 73.

Number 74 in FIG. 10 indicates a packet of cigarettes in accordance with a second variation of packet 1, and which, like packet 1, comprises a container 4, a removable lid 7, a hinged lid 5 (not shown in FIG. 10), and a collar 8 (not shown in FIG. 10). Though the component parts of packet 74 described above differ in shape and/or size from the respective component parts of packet 1, similar component parts are indicated using the same reference numbers as for packet 1 for the sake of simplicity.

Front wall 9 and rear wall 10 of packet 74 have curved portions 75 located at the lateral walls and which provide for connecting walls 9 and 10 to lateral walls 11. Curved portions 75 of front wall 9 comprise respective bottom portions 76 adjacent to bottom portion 16 of front wall 9, and respective top portions 77 adjacent to top portion 17 of front wall 9; and each curved portion 75 forms an edge 78 with the respective lateral wall 11. Central wall 21 of removable lid 7 comprises two curved portion 79 coplanar with portions 76 and 77.

Similarly, though not shown in FIG. 10, hinged lid 5 and collar 8 have respective walls 27 and 30 comprising curved portions at respective lateral walls 28 and 31.

Number 80 in FIG. 11 indicates a flat cardboard blank extending along a longitudinal axis X of symmetry and comprising a number of panels from which to form packet 74. For the sake of simplicity, and to relate blank 80 clearly to packet 74, each panel corresponding to a wall of packet 74 is indicated using the same reference number as for the wall, plus a (′), and the same reference numbers are used to indicate any parts similar to those of blank 34.

Blank 80 differs from blank 34 by being provided, at fold lines 35, with adjacent incision lines 81 parallel to axis X and forming panels 75′, 76′, 77′, 79′ and 82, which, when blank 80 is folded to form packet 74, curve and correspond respectively to the curved portions of rear wall 10, to bottom and top portions 76, 77 of curved portions 75 of front wall 9, to curved portions 79 of central wall 21 of removable lid 7, and to the curved portions of the central wall of the hinged lid not shown in FIG. 10.

In a further variation, not shown, of packet 1, the front wall and rear wall are connected to the lateral walls by curved portions with no edges and defined by incision lines in the blank; and the removable lid, hinged lid and collar also comprise curved portions connecting the respective central walls to the respective lateral walls.

Blanks 34, 69 and 80 have first panels to form container 4, second panels to form hinged lid 5, and third panels to form removable lid 7; the second and third panels are located on opposite sides; and the second panels define a larger surface area than the third panels.

What is claimed is:

1. A rigid cigarette packet substantially in the form of a right parallelepiped, extending along an axis (Z), and comprising a container (4), a group of cigarette (2), and a lid (5) hinged to said container (4) along a hinge (6); the container (4) comprising four walls (9, 10, 11) parallel to the axis (Z), forming a loop, and comprising a front wall (9), a rear wall (10), and two lateral walls (11); wherein at least the front wall (9) comprises a free edge (18) and said hinge (6) extends on the front wall (9);

a bottom wall (12) crosswise to the axis (Z);

a top wall (13) crosswise to said axis;

an inner compartment (14) housing the group of cigarettes (2), which are arranged parallel to said axis (Z);

an opening (15) for access to the compartment (14) and extending between the hinge (6) and said free edge (18);

wherein said hinged lid (5) comprises a central wall (27) rotating about said hinge (6), and two lateral walls (28) perpendicular to the central wall (27) and parallel to the lateral walls (11) of the container (4); and a collar (8) located inside said compartment (14) and having two lateral walls (31) located at respective lateral walls (11) of the container (4); each lateral wall (28) of the hinged lid (5) is located between a lateral wall (31) of the collar (8) and a lateral wall (11) of the container (4).

2. A packet as claimed in claim 1, wherein said front wall (9) comprises a first portion (16) of the front wall (9) adjacent to the bottom wall (12), and a second portion (17) of the front wall (9) adjacent to the top wall (13) and coplanar with the first portion (16); the first and the second portion (16, 17) of the front wall (9) being separated by said opening (15).

3. A packet as claimed in claim 1, wherein said hinge (6) is crosswise to said axis (z).

4. A packet as claimed in claim 3, wherein said free edge (18) is parallel to said hinge (6) and extends the full width of the front wall (9).

5. A packet as claimed in claim 1, wherein said opening (15) extends partly along the lateral walls (11).

6. A packet as claimed in claim 1, wherein the cigarettes (2) are arranged, inside said compartment (14), parallel to said axis (Z); and in that said bottom and top walls (12, 13) are perpendicular to said axis (Z) and separated by a distance greater than the length of said cigarettes (2).

7. A packet as claimed in claim 6, wherein said cigarettes (2) have filters (33) located adjacent to the top wall (13).

8. A packet as claimed in claim 1, wherein said cigarettes (2) are housed inside said compartment (14) and extend parallel to said axis (Z) between the two lateral walls (11); said lateral walls (11) facing each other and being parallel to each other and to the axis (Z).

9. A packet as claimed in claim 1, and comprising a removable lid (7) over said hinged lid (5).

10. A packet as claimed in claim 9, wherein said hinged lid (5) is the support for graphics and/or advertising.

11. A packet as claimed in claim 9, wherein said removable lid (7) is connected to the front wall (9) and to the lateral walls (11) of the container (4) along continuous tear lines (23, 24, 25, 26) forming an endless path.

12. A packet as claimed in claim 11, wherein said tear lines (23, 24, 25, 26) comprise a first tear line (23) adjacent to said hinge (6); and a second tear line (24) substantially coincident with said free edge (18).

13. A packet as claimed in claim 12, wherein said opening is defined laterally by a further two edges (19, 20) along each lateral wall (11) of the container (4); said further two edges (19, 20) being substantially coincident with two tear lines (25, 26).

14. A packet as claimed in claim 9, wherein said removable lid (7) comprises a central wall (21) substantially coplanar with the front wall (9) and superimposed on the central wall (27) of the hinged lid (5).

15. A packet as claimed in claim 14, wherein said removable lid (7) comprises two lateral walls (22) perpendicular to the central wall (21) of the removable lid (7) and coplanar with the lateral walls (11) of the container (4).

16. The packet as claimed in claim 14 comprising bevels (64) connecting the front wall (9) and the rear wall (10) to the lateral walls (11) of the container (4); said removable lid comprising two bevels (68) connecting the central wall (21) to the lateral walls (22) of the removable lid.

17. The packet as claimed in claim 14 wherein the front wall (9) and the rear wall (10) comprise curved portions (75) at the lateral walls (11) of the container (4); the central wall (21) of the removable lid (7) comprising curved portions (79) at the lateral walls (22) of the removable lid (7).

18. A rigid packet substantially in the form of a right parallelepiped, extending along an axis (Z), and comprising a container (4) and a lid (5) hinged to said container (4) along a hinge (6); the container (4) comprising:

four walls (9, 10, 11) parallel to the axis (Z), forming a loop, and comprising a front wall (9), a rear wall (10), and two lateral walls (11); wherein at least the front wall (9) comprises a free edge (18) and said hinge (6) extends on the front wall (9);

a bottom wall (12) crosswise to the axis (Z);

a top wall (13) crosswise to said axis;

an inner compartment (14);

an opening (15) for access to the compartment (14) and extending between the hinge (6) and said free edge (18);

wherein said hinged lid (5) comprises a central wall (27) rotating about said hinge (6), and two lateral walls (28) perpendicular to the central wall (27) and parallel to the lateral walls (11) of the container (4); and a collar (8) located inside said compartment (14) and having two lateral walls (31) located at respective lateral walls (11) of the container (4); each lateral wall (28) of the hinged lid (5) is located between a lateral wall (31) of the collar (8) and a lateral wall (11) of the container (4).

19. The packet of claim 18, further comprising a group of cigarettes disposed in the inner compartment.

20. The packet of claim 19, wherein the cigarettes are disposed parallel to the axis (Z).

* * * * *

UNITED STATES PATENT AND TRADEMARK OFFICE

CERTIFICATE OF CORRECTION

PATENT NO. : 6,974,027 B2
DATED : December 13, 2005
INVENTOR(S) : Silvano Boriani et al.

It is certified that error appears in the above-identified patent and that said Letters Patent is hereby corrected as shown below:

Title page,
Item [30], Foreign Application Priority Data, "(IL)" should be -- (IT) --.

Signed and Sealed this

Fourth Day of April, 2006

JON W. DUDAS
*Director of the United States Patent and Trademark Office*